United States Patent [19]

Schmidt

[11] Patent Number: 4,651,928

[45] Date of Patent: Mar. 24, 1987

[54] LIGHT DUTY OIL BURNER

[76] Inventor: Franklin Schmidt, Augsburger Str. 5, 8901 Kissing, Fed. Rep. of Germany

[21] Appl. No.: 674,952

[22] PCT Filed: Mar. 15, 1984

[86] PCT No.: PCT/EP84/00077

§ 371 Date: Nov. 15, 1984

§ 102(e) Date: Nov. 15, 1984

[87] PCT Pub. No.: WO84/03752

PCT Pub. Date: Sep. 27, 1984

[30] Foreign Application Priority Data

Mar. 16, 1983 [DE] Fed. Rep. of Germany ..... 3309301

[51] Int. Cl.[4] ..... B05B 7/00; B05B 1/24; F23M 9/00; F23D 11/44

[52] U.S. Cl. ..... 239/61; 239/75; 239/133; 239/135; 431/188; 431/208

[58] Field of Search ..... 239/13, 61, 75, 128, 239/132–132.3, 133, 135; 431/188, 208

[56] References Cited

U.S. PATENT DOCUMENTS

| | | | |
|---|---|---|---|
| 1,294,026 | 2/1919 | Ballard | 239/214.11 |
| 1,530,473 | 3/1925 | Ballard | 239/75 |
| 1,930,227 | 10/1933 | Donahue | 239/75 X |
| 2,156,405 | 5/1939 | Smoot | 431/265 |
| 2,158,359 | 5/1939 | Finnigan | 239/75 |
| 2,377,497 | 6/1945 | Hopkins | 239/75 |
| 2,453,416 | 11/1948 | Dom | 239/75 X |
| 2,491,201 | 12/1949 | O'Donnell et al. | 431/265 X |
| 2,513,720 | 7/1950 | Hallinan | 239/75 |
| 2,579,215 | 12/1951 | Te Nuyl | 239/75 X |
| 2,775,484 | 12/1956 | Fox | 239/75 |
| 2,840,148 | 6/1958 | Akesson | 239/133 X |
| 3,282,323 | 11/1966 | Katz | 239/75 X |
| 3,408,007 | 10/1968 | Raichle et al. | 239/135 X |
| 4,301,966 | 11/1981 | Schwarz | 239/75 |

FOREIGN PATENT DOCUMENTS

| | | | |
|---|---|---|---|
| 306211 | 2/1973 | Austria . | |
| 3013981 | 10/1981 | Fed. Rep. of Germany . | |
| 407920 | 6/1932 | United Kingdom | 239/75 |
| 1109530 | 3/1967 | United Kingdom . | |

*Primary Examiner*—Joseph F. Peters, Jr.
*Assistant Examiner*—Patrick N. Burkhart
*Attorney, Agent, or Firm*—Collard, Roe & Galgano

[57] ABSTRACT

In the case of a light duty oil burner designed for an hourly flow rate of less than 5 kg of oil, the oil burner having a nozzle head (3) associated with a heat exchanger (1), the nozzle head having an injection nozzle (7) mounted on a centrally positioned nozzle holder (8) and supplied with oil, and an outer combustion tube (4) placed around the holder of the injection nozzle (7) with the formation of a combustion air duct (5) connected with an air supply, it is possible to obtain a high overall efficiency and a good compatibility with the environment, while at the same time keeping to the basic concept of conventional light duty burners, by so designing the burner that the oil flow rate through the injection nozzle (7), that is in the form of a non-return spin or simplex nozzle with a constant nozzle cross section, and the air flow rate in keeping with the instantaneous oil flow rate, through the combustion air duct (5) may be controlled in keeping with the load, the air flow rate through the combustion air duct (5) being adjusted by the axial motion of an axially shifting servo member placed in the nozzle head (3), as a function of at least the load-dependent pressure of the oil in the oil flow path to the injection nozzle (7), this function being comprised in the oil pressure, and the servo member (ring 30) being able to be displaced against a return force.

27 Claims, 7 Drawing Figures

FIG. 4
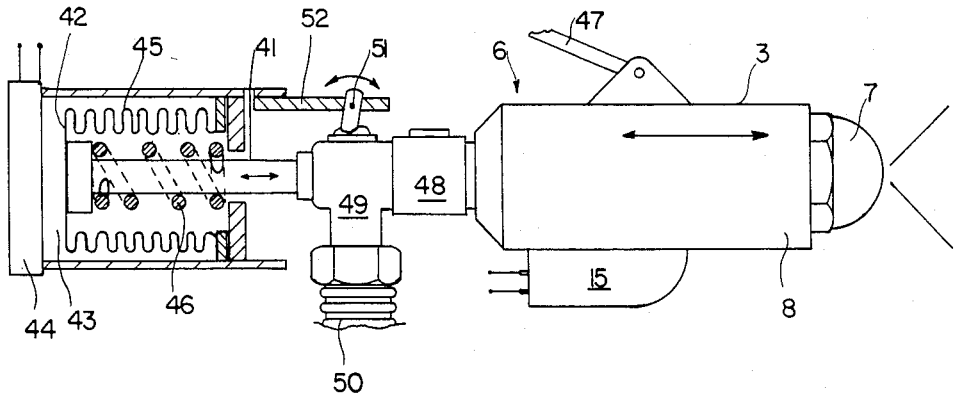
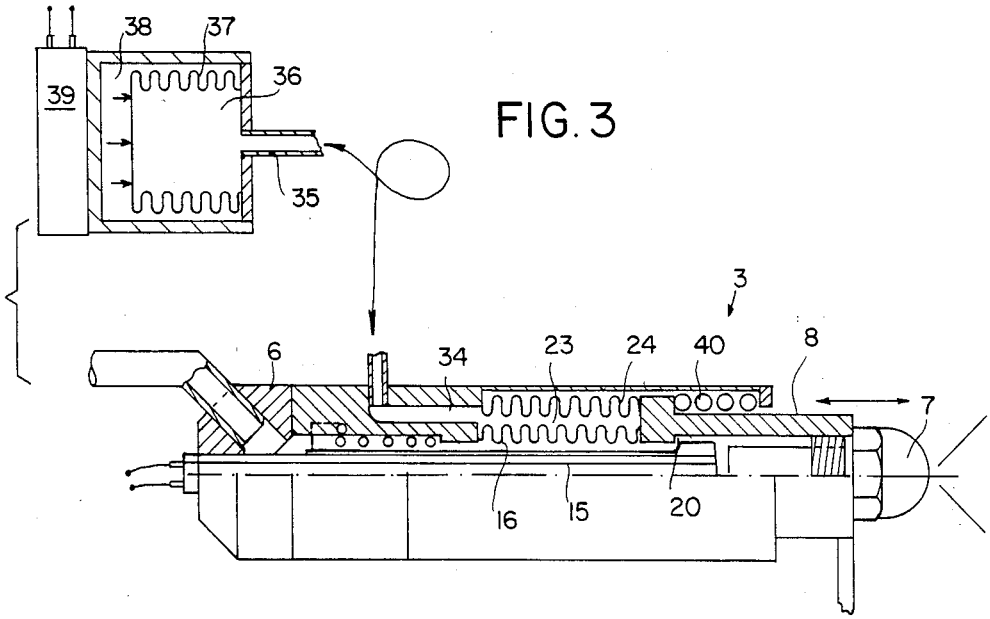
FIG. 3

LIGHT DUTY OIL BURNER

The invention relates to a light duty oil burner and more specially to push an oil burner designed for an hourly flow rate of less than 5 kg of oil, comprising a nozzle head associated with a heat exchanger, said nozzle head having at least one injection nozzle mounted on a centrally positioned nozzle holder able to be fixed on a nozzle mount and an outer combustion tube placed around the support system of the injection nozzle with the formation of a combustion air duct connected with an air supply.

High pressure oil burners, that are equipped with a so-called spin or simplex nozzle operate with the oil pressure fixed at a constant value and with a constant nozzle cross section, the oil flow rate being more or less unchanged. The volumetric air flow necessary for optimum combustion is determined in keeping with the maximum desired oil flow rate and fixed permanently. Operation under partial load conditions is in this respect controlled by changing the proportion of the time the burner is turned on. The turning on and off of the burner normally takes place using a thermostatically controlled two step automatic controller on the heat exchanger or some other load. Since the operational characteristic of the burner is controlling for the efficiency of the plant as a heat producer, it is not possible to reach the same efficiency when working under partial load conditions as is possible under full load conditions. In this connection it is assumed that in the non-operational periods, the make-ready losses in respect of the heat exchanger decrease the percentage of annual use of the plant. Further limitations in the use of heat reduce the times in which the burner is turned on even further and for this reason also increase the cooling down losses. It is further to be assumed that for every starting and switching off operation of the burner, there will be an increased formation of soot and an increased emission of substances having an undesired effect on the environment. On igniting the fuel-air mixture there is a sudden expansion of the heating gases because of the high rate of heating up, and there is a powerful pulse or surge produced on starting so that there are then surges in pressure in the combustion chamber, that lead to instable conditions in combustion and may considerably increase the amount of noxious substances evolved.

Furthermore high pressure oil burners are in use, in which the oil supply rate and the air supply rate are controlled so as to be dependent on the load. However, in this respect it is a question of comparatively large burners with comparatively large hourly oil consumption rates, in the case of which the overall size of the controller is hardly crucial. One known system of this sort has a return nozzle connected with an oil supply and an oil return. In the oil return there is an automatic pressure valve controlling the combustion rate of the injection nozzle by changing the return pressure. The plunger of the automatic pressure control valve is operated by a rocking lever, that follows a cam moved by a servo motor operated in accordance with the load. Furthermore there is a comb-like oblique slide mounted on the motor shaft having the cam, such slide cooperating with a fork connected with an air flap shaft. The controller is placed clear of the nozzle head in order to take into account the amount of available space. In this respect one undesired effect is the complexity and expense of a system having a return nozzle, this being necessary both for the design of the oil circuit having an oil supply and an oil return and furthermore for means to keep the oil supply and the oil return parts of the circuit separate form each other. One serious shortcoming in this known system is also to be seen in the overall size of the controller, that clearly is not able to be placed internally, i.e. within the nozzle head, and must be situated externally. Such an arrangement demands however not only a modification of the conventional design of a burner without any load-dependent control of the oil and air flow rates, this leading to a complex structure, but furthermore it is no longer possible for it to be accommodated in light duty oil burners.

Taking this as a starting point, the aim of the present invention is therefore to design a light duty oil burner of the sort noted initially, that has a comparatively high overall efficiency and a low amount of noxious substances in the flue gas, while at the same time being simple in structure and practically not making necessary any change in the basic design of systems of the sort in question.

This aim is attained in the present invention inasfar as in the case of a light duty oil burner of the sort noted initially, the oil flow rate through the injection nozzle, that is in the form of a non-return spin or simplex nozzle with a constant nozzle cross section, and the air flow rate in keeping with the instantaneous oil flow rate through the burner tube may be controlled in keeping with the load, the air flow rate being adjusted by the axial motion of an axially shifting servo member placed in the nozzle head, as a function of at least the load-dependent pressure of the oil in the oil flow path to the injection nozzle, such function being comprised in the oil pressure, such servo member being able to be displaced against a return force.

These measures give the advantage of a controller, that may be integrated in light duty oil burners of widely-known design for the load-dependent control of the oil and air flow rates. Since in this case the servo member is placed within the burner tube, the system becomes a very compact one offering the useful effect of a fixed connection of the servo member with the spool or slide for control of the air flow rate and a corresponding supporting effect for the servo member on a suitable spool for control of the oil flow rate so that by changing the first factor the other factor will be automatically changed as well and follow the first one. The simplex nozzle is not only cheap and little trouble to service, but furthermore makes it possible to control the oil supply at the same time, and such control for its part presents a simple possibility of matching to the necessary motion of the servo member. The matching of the air flow rate, possible with the measures of the invention, to the instantaneous oil flow rate makes possible, even when the oil flow rate is low, a more or less stoichiometric combustion without any great excess of air and for this reason a complete utilization of the fuel without excessive cooling of the flue gases. It will be seen from this that with the system of the invention it is possible to have a comparatively good efficiency not only under full load conditions but furthermore under partial load conditions. As a consequence of the load-dependent control of the oil and air flow rates it is possible to have a high turned-on time with the practical exclusion of losses through cooling and loading due to changes in temperature. Furthermore comparatively low flue gas temperatures become possible. As a consequence of the continuous rate control it is at the same time possible to be certain that the radiation losses are kept at a comparatively low level as well. Starting up conditions with the accompanying shortcomings are therefore infrequent. The adaptation produced in this connection, the accompanying useful effects, while keeping or even increasing the efficiency under full load conditions, of the instantaneous burner load to be in line with instantaneous needs, that may be advantageously determined by ascertaining the rate of temperature increase in the heat exchanger, for this reason give an excellent efficiency. The control of the instantaneous oil and air flow rate, that is to say of the energy supply to the heat exchanger, may in this respect be undertaken so simply that the rate of temperature increase fluctuates around the null point, the amount of energy supplied being generally equal to the energy output. The above discussion will serve to show that the invention attains its aim with simple and cheap means so that the overall economic picture is very favorable.

As part of a useful further development of the general features of the invention, the oil flow rate may be controlled by continuously influencing, in a load-dependent way, the pressure and the temperature of the oil delivered to the injection nozzle, the oil flow rate corresponding to the highest possible temperature setting for the oil and to the lowest possible setting for the oil pressure being best such that one may be sure of a sufficiently fine atomizing action. In this respect it is therefore possible to have a concurrent dependence on two functions that have more or less the same effect, and for this reason a particularly strong choking back of the oil flow rate under partial load conditions and consequently a particularly high burner on time and a specially low flue gas temperature and therefore a specially high efficiency. At the same time it is possible to take care of starting up troubles, since on ignition of the oil-air mixture there are partial load or minimum load conditions with a small volume of heating gas and for this reason throbbing or pulsation of the heating gases in the combustion chamber is more or less negligible. Although it is known that the viscosity of heating oil decreases with an increase in the temperature and that the rate of flow through a nozzle (unexpectedly) decreases with an increase in the oil temperature just as the case with decreasing oil pressure, this knowledge has so far only been practically used to tackle starting up and operation problems in known compact oil burners with two step control. For example it has been possible, by increasing in the oil temperature directly upstream from the atomizing nozzle to so influence the oil viscosity by means of a fitted heating means that the desired oil flow rate was obtained with a comparatively large nozzle bore without changing the fineness of atomization, see the German Offenlegungsschrift specification 2,719,573.

For the load-dependent control of the air flow rate it is possible to have at least one choke in the flow path of the combustion air, such choke being formed by a constriction in the burner tube and a valve member working therewith. It will be clear that such steps result in a highly simple and straightforward but nevertheless compact construction. It is convenient in cases in which the air flow through the burner tube is split up into a primary air flow passing through a baffle plate placed on the air outlet side and a secondary air flow passing round the baffle plate for only the latter air flow to be adjusted in accordance with the load. Therefore, when the air flow rate is low, the fraction of primary air goes up, this leading to the useful effect of good atomization.

As part of a particularly advantageous outgrowth of the general measures of the invention the servo member is able to be moved by a means of a movable confine means of a pressure chamber. This design advantageously enables one to obtain a pressure dependent and/or a temperature dependent displacement of the servo member.

In keeping with a further preferred development of these features, the pressure chamber may be placed in between the nozzle mount and the nozzle holder, it being possible in this connection for the servo member to be supported by way of the pressure chamber (that is preferably concentric to the nozzle axis) on a stationary part of the nozzle head. These measures lead to a highly compact arrangement, that is well suited to incorporation in a pre-existing oil burner. To do this it is only necessary to replace the previous nozzle head by a nozzle head in keeping with the present invention.

An advantage is to be gained by having a nozzle holder, that carries the injection nozzle and preferably the baffle plate, mounted on the nozzle mount, such holder defining the pressure chamber to form the servo member, the chamber furthermore being confined by the stationary nozzle mount. In this respect the nozzle holder forms the servo member, whose motion is transmitted and used for influencing the different control factors or quantities. In this respect the baffle plate, that is fixed to the nozzle holder will be moved in step with the nozzle holder forming the servo member so that the passage left between the outer baffle plate wall and the end cross section of the burner tube for the secondary air may be so influenced that when there is a decrease in the overall air flow rate, the proportion of primary air goes up.

In keeping with a further outgrowth of the general features of the present invention it is possible, in the flow path of the oil, to have a choke formed by two sealing faces, that are preferably placed near the injection nozzle and are pressed on to each other by a force that is varied by the displaceable servo member. The result is then that the desired oil pressure is produced as a function of the displacement of the servo member, such displacement for its part being temperature dependent for example.

In keeping for a further convenient feature, the pressure chamber may be in the form of a bellows, that is increased in size by an increase in size of its contents or by the action of pressure thereon and vice versa. This feature makes it possible, in a quite simple manner, to obtain a temperature dependent or pressure dependent activation of the pressure chamber. In this respect it is convenient for the pressure chamber to be in the form of a cylindrical double bellows, so that it is a question of a closed system shut off from the heating oil. In keeping with a useful form of the invention, the double bellows may be filled with refrigerant that is heated in accordance with the load. To this end the double bellows may be simply put into thermal contact with the oil moving past it that is load-dependently heated up by a heater in order to reduce its viscosity. The motion of the servo member due to the expansion and contraction of the pressure chamber as formed by the bellows—the pressure appearing as a function thereof—may in this respect advantageously be made to enter into a fixed relation dependent on the temperature, that is dependent on the load, of the oil flowing to the injection nozzle.

A further outgrowth of the general features of the invention is such that the one sealing face of the choke placed in the oil path is placed at the injection nozzle end of a displaceable tube, that is placed between the heater and the pressure chamber and is made up of thermally conducting material, such tube preferably being mounted with some play on the heater and having a seal of some sort between it and the stationary nozzle holder, the sealing face thereof fitting around a mating sealing face of the centrally placed heater, while the end thereof opposite to the sealing face is fitted around the servo member (that may be moved in relation to the stationary nozzle holder) and is supported thereon by a closing spring. The reaction force of the closing spring in this respect acts as a return force on the moving servo member so that in some cases it is possible to do without a further return spring. In this respect it is best for the stationary pressure within the bellows to be made so large that the closing spring is kept tensioned. This makes certain that the control system is in a position corresponding to the minimum load so that the number of changes in loading of the bellows are reduced and this leads to a useful increase in length of the working life of the system.

In keeping with an alternative form of the general features of the invention, the pressure chamber has an outlet on the injection nozzle side, that is in the form of a choke with a constant cross section and is acted upon by heating oil whose pressure may be controlled at a point upstream from the pressure chamber in a pressure dependent way. It this respect it is possible to design the pressure chamber in the form of a simple bellows through which the heating oil flows. The displacement of the servo member and for this reason the setting for the combustion air then appear as a simple function of the pressure that has been set. For the load-dependent control of the pressure of the heating oil upstream from the pressure chamber it is then simply possible to have at least one control valve fitted in the supply and/or return connectors downstream from the oil pump, such valves being operated in dependence on the load.

Further useful developments and advantageous forms of the general concept of the invention will be gathered from the following account of some working examples using the figures in conjunction with the rest of the dependent claims.

FIG. 3 is a view of a nozzle head with a double bellows acted upon by a fluid under presure and a moving nozzle holder.

FIG. 4 shows a form of the invention with a moving nozzle mount forming the servo member.

Figure 1:
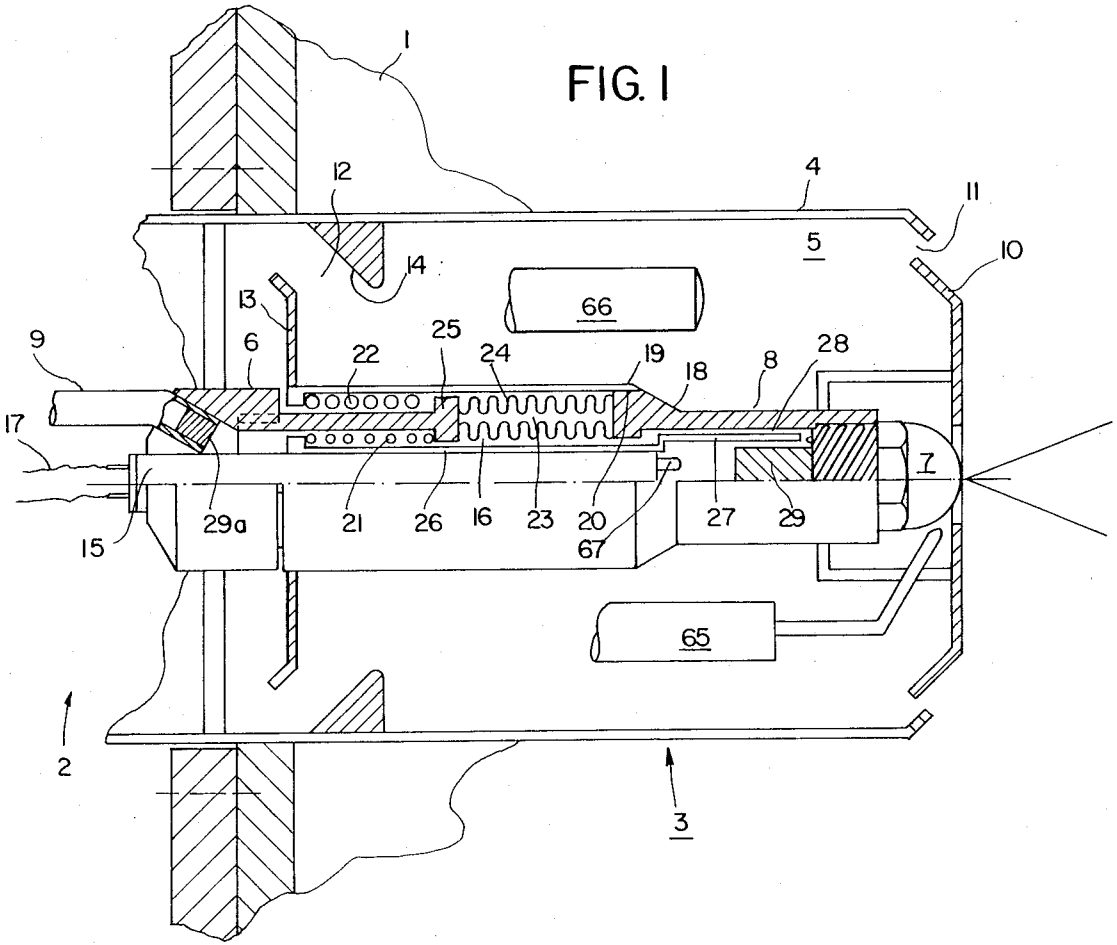
FIG. 1 shows a nozzle with a double bellows to be heated by the heating oil and a moving nozzle holder, partly in section.

The oil burner 2, that is to be seen in FIG. 1 and is flange mounted in a known way on a heat exchanger 1, for example one in the form of a heating boiler, has a nozzle head 3 with an outer combustion tube 4 and a centrally placed nozzle mount 6, on which a nozzle holder 8 is mounted that has an injection nozzle 7. The combustion tube 4 and the nozzle holder wall form a ring-like combustion air duct 5. The injection nozzle is in the form of a spin or simplex nozzle with a constant bore cross section and without any oil return provision. The injection nozzle 7 is supplied with heating oil at the pressure of a pump that is not illustrated in detail, such oil being injected into the combustion space of the heater exchanger 1. In this respect it is a question of a combustion system generally of the sort used on private premises. The oil burner 2 is therefore set for an hourly oil consumption rate of under 5 kg. Towards the front end of the burner tube 4 there is a baffle plate 10 having known air slots, such plate in the present case being simply mounted on the nozzle holder 8. It is by way of the radial slots in the baffle plate 10 that primary air is able to make its way into the combustion zone and through a ring-like gap 11 between the baffle plate and the front inwardly extending end of the burner tube 4 it is possible for secondary air to flow into the combustion zone. The ignition of the fuel air mixture is caused by an ignition electrode 65 placed for use with the injection nozzle 7. To monitor the flame there is a photoelectric cell 66 placed in the combustion air duct 5.

To ensure steady-state operation and a good efficiency, the rate of oil injection is all the time changed to be in line with the energy need of the heat exchanger 1. At the same time the rate of supply of combustion air is so matched to the instantaneous oil flow rate that there is generally stoichiometric combustion. To this end, the rate of temperature increase at the heat exchanger 1 is ascertained and used as an input quantity for the control. The control of the flow of oil and air, that is to say the supply of energy to the heat exchanger 1 is in this respect so undertaken that the speed of rise in the temperature is as far as possible zero or comes close to zero so that one then obtains a stable state with respect to the supply and output of energy. The outside temperature may enter in the form of a cascade value into the control input quantity as a level factor.

The air flow rate through the combustion air duct 5 is controlled by the load-dependent modification of its free flow cross section. To this end there is a choke 12, that is formed by disk plate 13 and a constriction 14 in the combustion tube 4 cooperating therewith. The choke 12 is set in a way which will be described in detail later. The oil flow rate through the unadjustable, returnless injection nozzle 7 is controlled by a load-dependent modification of the temperature and the pressure of the oil supplied to the injection nozzle 7. The viscosity of the heating oil decreases with an increase in temperature. The oil flow rate may therefore be choked back by increasing the temperature and lowering the pressure and vice versa.

For changing the supply temperature of the heating oil arriving at the injection nozzle 7 there is a heating device 15 that in the present case is in the form of a centrally placed heating rod in the flow path of the heating oil supplied by way of the pressure connector 9 of the injection nozzle 7, in the form of a returnless duct 16 that is ring-like or annular in cross section. The heating device 15 is so controlled by way of signal leads 17 to be dependent on the rate of temperature increase at the heat exchanger 1 that the temperature is increased when less energy is needed, and vice versa. For improving conditions on starting up the system is started with a minimum oil flow rate. This may be simply ensured by monitoring the temperature with the help of the start thermostat 67, that only enables burner operation when the necessary oil temperature has been reached.

For modifying the oil temperature in the path formed by the duct 16 there is a choke 18, whose sealing faces 19 and 20 are lifted clear of each other by the oil passing through the choke against the force of a closing spring 21. It would be possible to have a separate effect dependent on load on the oil temperature and the pressure thereof and so on the oil flow rate. In the present working example the oil temperature that may be produced by the heating device 15 is at the same time used as an input control quantity for setting a desired oil pressure and an air flow rate as dependent on the oil temperature and oil pressure. To this end in the illustrated example of the invention the nozzle holder 8 is mounted shiftingly on the stationary nozzle mount 6. The shifting nozzle holder 8 in this respect practically forms a shifting servo member for adjustment of the baffle member 13 fixed at this point and of the closing force, that has to act at the choke 18, of the closing spring 21, that is also able to be entrained thereby to one side.

For the displacement of the shiftingly mounted nozzle holder 8 against the force of a return spring 22 resting on the stationary nozzle mount, there is a pressure chamber 23, that in the present case is in the form of the inner space of a cylindrical double bellows 24 placed round the heating device 15, such bellows 24 being delimited by the opposite faces of the stationary nozzle mount 6 and of a flange 25 fixed thereto of the nozzle holder 8, that is able to be shifted in relation thereto. The pressure chamber 23 is filled with a refrigerant, that when heated expands and vice versa. For heating the pressure chamber 23 it is possible to have an integral load-dependently controlled heating device. In the illustrated working example of the invention, the transmission of heat to the double bellows 24 is through the heating oil, that for its part is changed in its temperature by the associated heating device 15. To this end the flow path, formed by the duct 16, of the heating oil simply runs between the heating device 15 and the double bellows 24.

To form the choke 18 there is a reciprocating tube 26 that is placed on the heating rod forming the heating device 15 and which has a collar with a sealing face 20, that fits round an edge (that forms the sealing face 19 and is itself undercut) on the shifting nozzle holder 8 and is kept against the nozzle mount by the closing spring 21. To make this possible the tube 26 has a flange 26' disposed between flange 25 and nozzle mount 6, the closing spring 21 acting against the flanges. The force produced by the closing spring 21 and which is dependent on the setting of the moving nozzle holder 8 practically constitutes the closing force at the choke and for this reason at the constant oil pressure of the oil coming from the pump determines the opening cross section of the choke 18 and for this reason the pressure of the oil at the nozzle 7 downstream of the choke 18. In order to make certain that the oil has to pass through the choke 18, the ring-like gap between the tube 26 and the heating device within it is sealed off. To ensure satisfactory thermal transmission the tube 26, made of thermally conducting material, makes thermal contact with the outer heating faces of the heating device 15. The flow path formed by the duct 16 for the oil runs radially outside the tube 26 between the tube and the double bellows 24. Because of the choke 18 downstream from this it is possible to make certain that all the space between the tube 26 and the double bellows 24 is filled with oil so that there is a reliable transmission of heat to the double bellows 24.

The supply of energy to the heating device 15 is inversely proportional to the temperature rise rate at the heat exchanger 1. If the temperature rise rate is excessive and is to be decreased, the supply of energy to the heating device is increased so that the release of heat to the oil moving through the duct 16 is increased and this leads to a reduction in the viscosity of the oil so that, if the oil pressure at the injection nozzle 7 that has a constant nozzle bore diameter is kept unchanged, the oil flow rate goes down. The thermal transfer effected by the oil passing through the duct 15, to the double bellows 24 leads at the same time to a heating up and for this reason expansion of the refrigerant within the pressure space 23 and therefore the double bellows 24 becomes longer and causes a displacement to the right of the shiftingly mounted nozzle holder 8 in terms of FIG. 1. The nozzle holder 8 carries with it the tube 26 (that positively cooperates with the choke 18) so that the closing spring 21 is compressed and this leads to an increase in the closing force acting at the choke 18. This increase in the closing force at the choke 18 is responsible, if the pumping pressure is unchanged, for a pressure drop downstream from the choke 18 and for this reason for a decrease of the oil pressure governing the injection rate through the nozzle 7. The baffle member 13, that is fixed on the nozzle holder 8 is moved at the same time and comes nearer to the constriction 14 associated therewith so that the air flow rate through the combustion air duct 5 is choked back. In the present working example the baffle plate 10 is moved in step with the nozzle holder 8 to which it is in fact fixed, in such a way that the ring-like gap 11 for the secondary air is narrowed. The supply of energy to the heating device 15 in this case leads not only to a reduction in the oil viscosity but furthermore and at the same time to a decrease in the oil pressure which is controlling for the injection rate and to a choking back of the air supply rate that matches the greatly reduced oil flow rate, such choking action being particularly pronounced with respect to the secondary air.

For degassing the oil supplied to the nozzle bore of the injection nozzle 7 the tube 26 has an extension on the collar (that has the sealing face 20) and this extension 27 defines with the nozzle holder 8 a ring-like gap 28 adjoining the choke 18. At this ring-like gap the oil will reach a comparatively high speed before it flows through the upstream filter or strainer 29 into the helical supply duct to the bore of the injection nozzle 7 that is in the form of a spin or simplex nozzle. Because of the high speed of the oil in the ring-like gap 28 air inclusions are entrained as well so that it is not possible for any large bubbles to form. To increase operational reliability it is possible to have a further oil filter **29*a* in the exit part of the pressure connector 9**. This makes possible a prefiltering of the oil so that even in the case of small widths of the gap of the order 1/10 mm at the choke no trouble conditions are likely.

Figure 2:
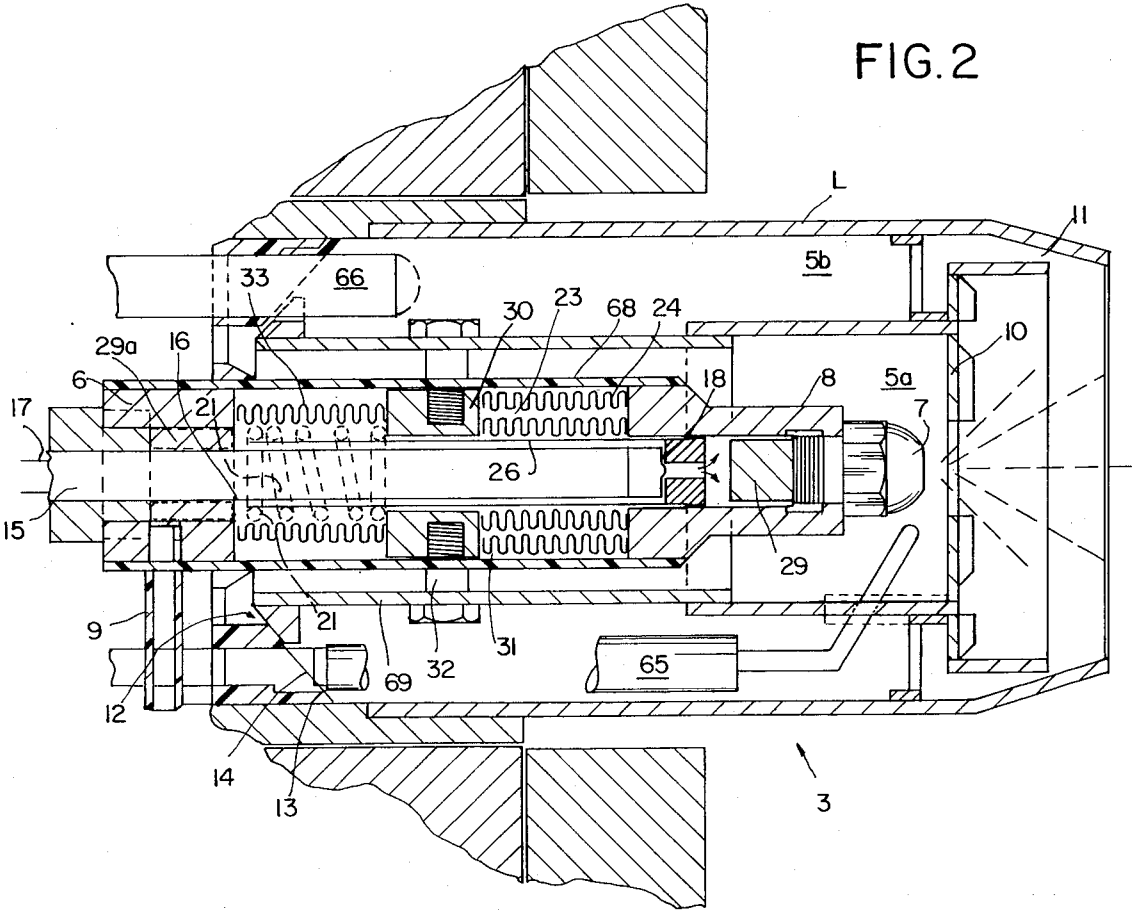
FIG. 2 shows a nozzle head with a double bellows to be heated by the heating oil, there being a separate servo member.

The basic design of the arrangement of FIG. 2 is generally on the same lines as the system described so far so that like reference numerals are used for like parts. In the example as in FIG. 2 the double bellows 24 with the pressure space 23 within it is delimited at the one end by the nozzle holder 8 and at the other end by a shifting ring 30. In this respect the nozzle holder 8, unlike the construction in FIG. 1, is fixedly joined to the stationary nozzle mount 6 by way of an apron such as a sleeve 68 therearound or the like. In this case the ring 30 forms the shifting servo member that serves to adjust a choke 18 in the flow path of the oil and the choke 12 in the flow path for the air formed by baffle member 13 and cooperating constriction 14. Unlike the construction of FIG. 1 in the system of FIG. 2 the combustion air duct defined by the combustion tube 4 is divided up by an air guide tube 69, radially spaced from and placed around the nozzle mount 6 and the nozzle holder 8, into a primary air duct 5*a* associated with the baffle plate 10 and a secondary air duct 5*b* associated with the ring-like gap 11 between the baffle plate 10 and the combustion tube 4. The air guide tube 69 is in this respect so placed that at the constriction 14 the air flow may be divided. The metering of the air flow to be effected by the ring 30, that forms the servo member, in the cases takes place by shutting down the secondary air duct 5*a*. To this end the air supply tube 69 is fixedly jointed to the ring 30 and at its circumference it is joined to the baffle plate 13 associated with the constriction 14. The inlet into the primary air duct 5*a* is not influenced by the baffle member 13 so that even at a low overall air flow rate there is a high proportion of primary air and for this reason effective atomization. The ring-like gap 11 between the baffle plate 10 and the combustion tube 4 does not have to be modified in this design. In this case the baffle plate 10 may be stationary. In the present example, the baffle plate 10 is fixed on the combustion tube 4. The air supply tube 69 in this case extends through as far as the baffle plate 10. To make possible the necessary mobility of the air guide tube 69, it is simply made in the form of a two-part telescoping tube. It would furthermore be possible to have the baffle plate 10 mounted on the front end of the air guide tube 69 so that the same might be made in one piece and at one and the same time there would be an adjustability of the gap 11 between the baffle plate 10 and the burner tube 4.

The sleeve 68 connecting the nozzle mount 6 with the nozzle holder 8 is in this respect designed with slots 31 in the range of adjustment of the ring 30 and there are holders 32 (fixed to the ring 30) running through the slots. The air guide tube 69 is mounted on the holders 32. The ring 30 is supported by way of a return spring, in the form of a simple bellows 33, against the action of the pressure space 23 on the nozzle holder 6. The simple bellows 33 seals off the oil flow path from the pressure connector (so that the oil is under pressure, such pressure also acting on the ring 30) from the outside. Such flow path is in the form of the duct 16 placed around the rod-like heating device 15 so that it is not possible for any oil to be lost through the slots 31.

The oil flow path formed by the duct 16 leads in this case between the rod-like heating device 15 and the tube 26, placed around it with a radial clearance, such tube 26 having a collar fitting around the end face on the nozzle head side of the heating device to form the choke 18. The opposite end of the tube 26 fits within the ring 30 and is kept thereon by the closing spring 21. The space between the tube 26 and the double bellows 24 filled with refrigerant is joined with the oil flow path so that it is filled with oil. The front end of the tube 26 makes sealing contact with the wall face of an associated hole in the nozzle holder 8 so that all of the oil flow has to make its way through the choke 18. The stationary oil filling between the tube 26 and the double bellows 24 means that there is a dependable conduction of heat. When heat is given up through the centrally placed heating device 15, the oil flowing through the duct 16 placed directly around the heating device will be heated up and part of the heat from the oil will be conducted away into the tube 26, when the heat is transferred by the said oil filling to the double bellows 24. The refrigerant, that expands, because of the heating effect, in the pressure chamber 23, takes effect on the ring 30 forming the servo member so that the closing force of the closing spring 21 will increase and the tube will be acted upon by a stronger force in the sealing direction of the choke 18. At the same time there will be a corresponding motion of the air guide tube 69 and for this reason of the baffle member 13. The design in respect of the forces produced is best so made that in the case of a pre-determined pump pressure, the force caused by static pressure within the pressure chamber 23 acting on the ring 30 is larger than the force of the closing spring 21 so that in the static condition the servo member is not in the position corresponding to full load but to minimum load, this making it possible to decrease the number of necessary motions of the bellows 24 and of the bellows 33, while at the same time making certain that the sealing face of the moving tube 26 smartly closes the choke 18 like a high-speed valve (so that there is no dribble from the injection nozzle) when the pumping pressure falls to zero. This is naturally also true of the other forms of the invention. Therefore a supply of energy to the heating device 15 causes, in the case of this form of the invention as well, not only a reduction in the viscosity of the oil but a concurrent decrease in the pressure of the oil supplied to the injection nozzle 7 and simultaneously to a choking back of the air flow rate.

Figure 7:
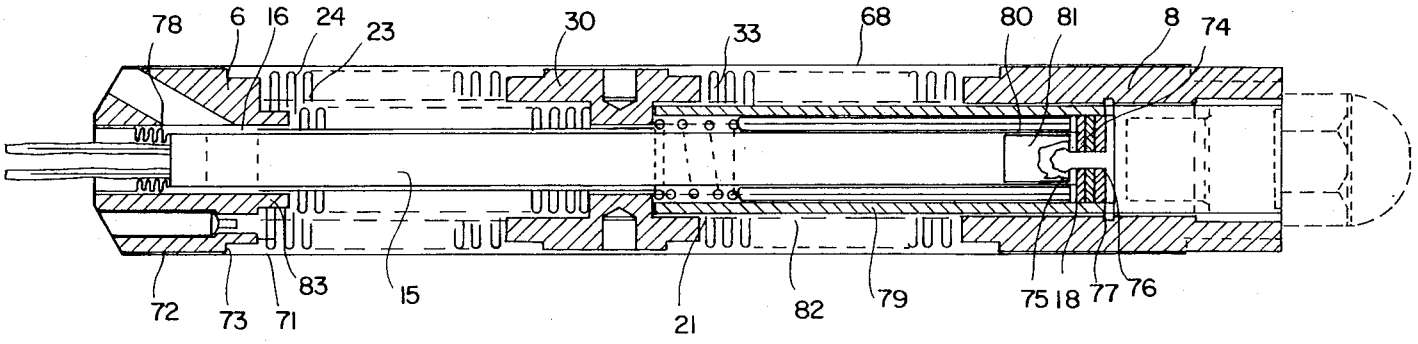
FIG. 7 shows a modified form of the device of FIG. 2 with a double bellows placed on the nozzle mount side.

In its basic design the arrangement of FIG. 7 resembles that of FIG. 2 as described hereinbefore. The following account of FIG. 7 is therefore focussed on the differences, and for like parts like reference numerals are used. In the arrangement of FIG. 7 the double bellows 24 (delimiting the pressure space 23) at one end is in contact with the ring 30 forming the servo member and at the other end it directly makes contact with the stationary nozzle mount 6. The space between the ring 30 forming a servo member and the nozzle holder 8, fixedly joined to the nozzle mount 6 by way of the sleeve 68, is sealed off by the simple bellows 33, that simultaneously acts as a return spring for the ring 30. The arrangement of the double bellows 24 limiting the pressure space 23, made possible in the present case leads to the useful effect of there being only a comparatively small setting force and for this reason comparatively small bellows diameters; and generally the arrangement is made more compact. In this connection, one in fact assumes that the heating rod forming the heating means 15 will be very much hotter at its front part near the nozzle holder than at its back part near the nozzle mount. The refrigerant enclosed within the pressure space 23 is in this case therefore only exposed to the lower temperature to be expected at the back part of the heating rod, this being a useful effect. A further advantage is that the refrigerant may readily be filled into the pressure space 23. To this end the nozzle mount 6 is simply made with an axial hole 71 shut off by a grub screw. It is an advantage to have a thermoelement 73 in the axial hole 71 to sense the temperature in the pressure space 23. The placing of the thermoelement 73 at the nozzle mount end gives the further advantage of a simple arrangement of the connections. Monitoring the temperature in the pressure space 23 makes it simpler to control the fuel flow rate. This flow rate is automatically controlled in a way dependent on the temperature in the pressure space so that the controlled object is comparatively short, the rate of increase in the temperature being applied in the form of a cascade value at the heat exchanger 1.

The choke 18 is in the present case defined by a disk 74, that is placed in the nozzle holder 8 (which is fixed to the stationary nozzle mount 6) and has a central hole and by a ball 75 placed on the opposite end of the heating rod forming the heating device 15. The disk 74 having the hole 76 is placed stationarily on a stop 77 formed by a shoulder etc. of the nozzle holder 8. The heating rod forming the heating device 15 is, unlike the constructions noted hereinabove, not in this case fixedly joined to the nozzle mount 6 but may be moved axially and radially. In the axial direction the heating rod rests by way of the closing spring 21 (that cooperates therewith) against a ring 30 forming the servo member, this making opening and closing of the choke 18 possible. In the radial direction the heating rod has so much play that the ball 75 is self-centering on the facing edge of the hole 76. The floating arrangement of the heating rod forming the heating device 15 therefore makes possible a reliable sealing seat at the choke 18 without any precision finish on the heating rod, this making production less involved. Because of the stationary placement of the disk 74 it is furthermore possible to ensure a reliable sealing effect between the disk 74 and the nozzle holder 8 with simple means. At the same time the floating arrangement of the heating rod carrying the ball 75 means that on opening or closing the choke 18 no great frictional forces have to be overcome, this also having a favorable effect as regards decreasing the necessary setting forces and for this reason producing a compact structure. The floating arrangement of the heating rod 15 furthermore makes it possible to do without a holder for heating rod at the nozzle mount end, this being a further useful effect. The arrangement as in FIG. 7 therefore gives the useful effect of a comparatively small diameter of the heating rod, and this again is not without a useful effect on the production of a compact design and the avoidance of losses through radiation as a result. The hole, in which the heating rod is floatingly placed, in the nozzle mount 6 is in the present case simply sealed off by a metal bellows 78 resting against the back end of the heating rod and mounted in the hole in the nozzle mount.

For limiting the setting motion of the ring 30 in the direction corresponding to an increase in the closing force at the choke 18, there is a sleeve 79 that is placed within the simple bellows 33 and supported against the disk 74 placed in the nozzle holder 8. This sleeve 79 thus determines or presets the strongest compression of the closing spring 21 and therefore the maximum closing force at the choke 18. To form a support shoulder on the heating rod side next to the closing spring 21 there is a bush 80 screwed on the heating rod. To make this possible the heating rod has a threaded pin 81 on its front end, on which the bush 80 may be screwed and which receives the ball 75 at its front end. The bush 80 screwed on the heating rod may therefore be readily removed so that parts to the back of the bush, as for example the closing spring 21, may readily be replaced. The measures just described therefore mean that the system may be readily assembled. To produce a large thermal transfer surface at the flow path 16 between the bush 80 and sleeve 79, the bush 80 may have threads on its outer face 82.

To produce a smooth and trouble-free flow of the oil in the part of the flow path 16 within the double bellows 24 there is a guide tube 83 surrounding the heating rod with radial play, such tube 83 being fixed on the ring 30 forming the servo member. For this purpose the guide tube is made with a claw fitting around the edge, nearest the closing spring, of the ring 30, such claw therefore being pressed by the closing spring against the shoulder therefor on the ring 30. This means that the tube 23 is entrained every time the ring 30 moves. The guide tube 83 makes possible a high oil flow rate, and for this reason, a good transfer of heat. Simultaneously the system makes certain that the radially inner folds of the double bellows 24 are only filled by stationary oil so that on the one hand there is good transfer of heat to the refrigerant in the back space 23 and on the other hand there is no interference with the flow by the edges of the double bellows 24. Simultaneously the guide tube 23 supports the double bellows 24 on the inside so that there is no danger of the bellows' kinking.

In the arrangement of FIG. 3, that basically resembles that of FIG. 1, the shifting nozzle holder 8, that here again acts as the servo member for simultaneous setting the air flow rate and the oil pressure, may be moved by pressure acting on the pressure chamber 23, that is formed by the double bellows 24, that for its part is limited by the opposite faces of the shifting nozzle holder 8 and of the stationary nozzle mount 6. For this purpose the pressure chamber 23 is joined by way of a hole 34 on the nozzle mount side and a pressure duct 35, joined therewith, with a pressure build up space 36 placed outside the burner nozzle 3, and from which a pressure medium, as for example in the form of hydraulic fluid may be displaced in a way dependent on the load. For this purpose the pressure build up space 36 is, in the present example, formed by a simple bellows 37, that is placed in a chamber 38 filled with refrigerant, such chamber being able to be load-dependently heated, that is to say, so heated that when there is an excessive temperature increase rate in the heat exchanger connected with the burner nozzle 3, heat is given up to the chamber 38. The outcome of this is that the refrigerant in the chamber 38 expands and the bellows 37 is compressed so that hydraulic fluid is expelled from the pressure build up space and moved into the pressure chamber 23. The hydraulic fluid leads to an expansion of the double bellows 24 and therefore to a displacement of the nozzle holder 8, that is shiftingly mounted and in the present case forms the servo member, against the force of a return spring 40 supported on the nozzle mount side. The motion of the nozzle holder 8, that in the present case forms the servo member, is used in a way ressembling the method described in connection with FIG. 1, for influencing the oil pressure upstream from the choke 18 and the air flow rate. Reference may therefore be had to the remarks in connection with FIG. 1 in order to avoid repetition. In the design of FIG. 3 there is again a heating device 15, formed by a centrally placed heating rod, for heating the oil moving through the duct 16 and therefore for reducing the viscosity of such oil. The heating device 15 used for heating the oil passing through ring-like gap 20 and the heating device 39 for the chamber 38 with the pressure build up space 36 within it, may be conveniently controlled in parallel.

In the arrangement of FIG. 4 the nozzle mount 6 with the nozzle holder 8 and the injection nozzle 7 form the servo member, whose motion is used to modify the effective oil pressure and the air flow rate. To this end the nozzle mount 6 is able to be shifted and joined by way of rod 41 with the moving wall 42 of a pressure chamber 43 placed outside the burner nozzle 3. The pressure chamber 43 is filled with refrigerant whose temperature is controlled in keeping with the load by way of its heating device 44. The heating device 44 may for this purpose be controlled in parallel with a heating device 15 at the nozzle holder 8 for influencing the nozzle and for this reason the viscosity of the heating oil moving through the burner nozzle. There is a bellows 45 projecting into the pressure chamber 43 and the end wall, nearest the chamber, forms the moving chamber wall 42 and is connected with the rod 41.

As a consequence of the expansion of the refrigerant in the pressure space 43, the bellows is compressed and vice versa. The return motion is supported by a return spring 46. In place of the bellows system as used here, it would naturally be possible to have a cylinder and piston unit. The motion of the wall 42 is transmitted to the servo member by way of the rod 41. The control of the combustion air flow may be by way of a baffle member that is fixed to the nozzle mount 6 and cooperates with a constriction on the air tube side, or, as in the present case, by way of a linkage 47 entrained by the nozzle mount 6. It would furthermore be possible to have an electrical, an optical or pneumatic sensing system. In each case a metering device is controlled by such system. For influencing the oil pressure on which the injection operation is dependent, there is a regulating valve 48, that is placed on an inlet connector 49 joined to the nozzle mount 6. The connector 49 is joined up by way of movable hose 50 with a pump, that is not shown in the figure. The regulating valve 48 is fitted with a regulating lever 51 cooperating with a stationary ramp edge. In the present example of the invention the regulating lever 51 simply stretches through an opening therefor in a bar 52, that is fixed to the housing of the pressure chamber 43, that may be fixed stationarily to the oil burner housing. When the nozzle mount is moved, the regulating lever 51 is rocked and for this reason the oil pressure reduced or decreased in step therewith.

Figure 5:
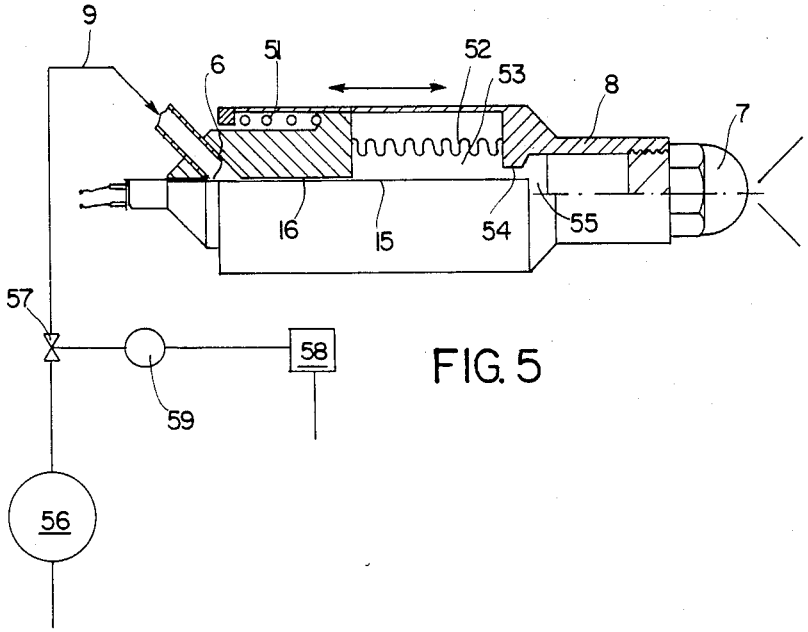
FIG. 5 shows a nozzle head with a simple bellows placed in the flow path of the heating oil and the pressure controller placed upstream from the same.

In the example to be seen in FIG. 5, the oil pressure is used as an input control quantity for the servo member for influencing the air flow rate. The viscosity of the oil may be influenced by a heating device placed in parallel thereto. The servo member is in this form of the invention formed by the nozzle holder 8, that is opposite the stationary nozzle mount 6 and the nozzle holder 8 is in this case a simple bellows 52 placed around the centrally placed heating device 15, such bellows 52 surrounding a pressure chamber 53, into which the duct 16 opens, which defines the oil flow path and which is supplied by way of the pressure connector 9. Therefore the duct 16 is directly supplied with the heating oil. The pressure chamber 53 is directly joined by way of the ring-like gap 54 with the space upstream from the injection nozzle 7. The cross section of the ring-like gap 54 is so sized in this case that there is no, or practically no, predetermined choking effect. The pressure of the heating oil reaching the pressure space 53 causes an expansion or a reduction in size of the bellows 52 and therefore a corresponding shift of the movable nozzle holder 8 forming the servo member. The oil pressure is in this case set in keeping with the load upstream from the pressure chamber 53 so that the nozzle holder 8 forming the servo member is moved in a way dependent on the load, such movements then being able to be followed for the load-dependent control of a number of input quantities. To this end there is a regulating valve 57 at the pressure connector 9 connected with the pump 56. This valve 57 is set by a servo motor 59 controlled load-dependently by way of a regulator 58. The operation of the servo motor 59 may be parallel to the control of the heating device 15 for the reduction of viscosity.

In a further possible form of the invention the regulating valve 57 may be placed at the return connector of the pump 57. In arrangements of this sort it would be possible to have constant volume pumps. However it would furthermore be possible to have a pump controlled load-dependently with an adjustable volume or a multi-stage pump.

Figure 6:
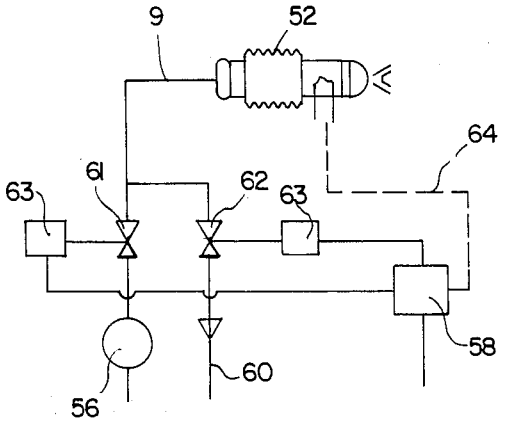
FIG. 6 is a view of changed form of the design of FIG. 5 with a different pressure controller.

In the case of the working example of the invention to be seen in FIG. 6, solenoid valves are used for pressure control. To this end the pressure connector 9 supplied from the pump 56 has a relief connector 60. In the pressure connector 9 and the relief connector 60 there are respective valves 61 and 62, that are opened and closed by way of their driving electromagnets. The driving magnets 63 are so controlled from an automatic controller 58 that the pressure in the pressure connector 9 is increased and decreased in steps to keep pace with the load, that is to say the heat need of a heat exchanger. Under full load conditions the relief connector 60 has its valve 62 in the closed condition. During part load operation this valve 62 and the valve 61 on the pressure connector 9 will be opened. In the illustrated working example only a two step control system is shown for simplicity. By increasing the number of valves it would however be possible to have a greater number of steps. If there is heating device 15 in the form of a heating coil for influencing the oil viscosity, it may be operated in parallel to the drive magnet 63, as is indicated by signal lead 64, marked in broken lines.

I claim:

1. In a light duty oil burner, such as an oil burner adapted for an hourly flow rate of less than 5 kg of oil, having a nozzle head associated with a heat exchanger, the nozzle head having an axis and at least one injection nozzle, in the form of a non-return spin or simplex nozzle with a constant nozzle cross-section, mounted on a centrally disposed nozzle holder attached to a fixed nozzle mount and an outer combustion tube encircling the injection nozzle, nozzle holder and nozzle mount forming a combustion air duct communicating with an air supply, the improvement comprising:

means for controlling the oil flow rate through the at least one injection nozzle and the air flow rate, corresponding to the instantaneous oil flow rate, through the combustion air duct, in response to the energy requirements of the heat exchanger;

said control means, so as to adjust the air flow rate through the combustion air duct, including a servo member disposed in said nozzle head axially moveable against a return force, at least one choke in the flow path of the combustion air formed by a constriction in the outer combustion tube and a baffle member cooperating therewith and attached to said servo member;

means for adjusting the oil pressure in the oil flow path to the injection nozzle responsive to the energy requirements of the heat exchanger; and means for axially moving said servo member in response to at least the adjustment of the oil pressure in the oil flow path to the injection nozzle, said means comprising a pressure chamber formed by a cylindrically shaped double bellows which expands and contracts upon the expansion or contraction of its contents and which further comprises heating means disposed centrally within said bellows which is responsive to the energy requirements of the heat exchanger.

2. The light duty oil burner as defined in claim 1, which further comprises a baffle plate disposed at the air outlet side of the combustion air duct which divides the air flow through the combustion tube into a primary air flow passing through the baffle plate and a secondary air flow passing around the baffle plate and wherein the secondary air flow is adjusted by said servo member.

3. The light duty oil burner as defined in claim 2, wherein said baffle plate has an outer edge which forms a choke with said combustion tube by constricting the air outlet side of the combustion air duct, said baffle plate being fixedly attached to said nozzle holder.

4. The light duty oil burner as defined in claim 2, which further includes an air guide tube disposed concentrically within said combustion tube for separating said secondary air flow from said primary air flow, said air guide tube being an axially telescoping tube directed toward said baffle plate and fixedly attached to the axially moveable servo member, said air guide tube carrying thereon said baffle member of said combustion air choke which projects into the secondary air flow and which cooperates with the constriction of said choke in the outer combustion tube.

5. The light duty oil burner as defined in claim 1, wherein said pressure chamber is filled with refrigerant and said heating means thermally communicates with said pressure chamber by means of the oil supplied to said injection nozzle.

6. The light duty oil burner as defined in claim 5, wherein the oil flow path is from a pressure connector at the nozzle mount to the injection nozzle between said centrally disposed heating means and the pressure chamber disposed therearound.

7. The light duty oil burner as defined in claim 1, wherein the means for controlling the oil flow rate includes means for continuously influencing the pressure and temperature of the oil delivered to the injection nozzle in response to the energy requirements of the heat exchanger, so that the oil flow rate corresponding to the highest possible temperature setting for the oil and to the lowest possible setting for the oil pressure is such that a sufficiently fine atomization of the oil results.

8. The light duty oil burner as defined in claim 1, wherein said double bellows defining said pressure chamber is disposed concentrically with respect to the axis of the injection nozzle within said nozzle head on a stationary part thereof between said nozzle mount and said nozzle holder so as to support said servo member.

9. The light duty oil burner as defined in claim 8, wherein said nozzle holder is slidingly supported on said nozzle mount to form said servo member, said nozzle holder being moveable by said pressure chamber which is disposed between and delimited by said nozzle holder and said nozzle mount.

10. The light duty oil burner as defined in claim 8, wherein a connection sleeve fixedly connects said nozzle holder to said nozzle mount, said connection sleeve having at least one slot formed therein for accepting the passage of a holder, said oil burner further including an axially moveable ring connected to said holder and which delimits said pressure chamber, said ring forming said servo member and being connected therethrough to said baffle member.

11. The light duty oil burner as defined in claim 1, which further comprises a choke in the oil flow path to the injection nozzle, said choke being formed by two sealing faces disposed near the injection nozzle which are moved towards each other by the movement of said servo member.

12. The light duty oil burner as defined in claim 6, wherein at least one oil filter is disposed in said nozzle mount in the oil flow path to the injection nozzle.

13. The light duty oil burner as defined in claim 11, wherein one sealing face of said choke is formed on a sliding tube disposed between said heating means and said pressure chamber, said tube being formed of heat conducting material, and closing spring means acting on said tube in the direction of closing said choke.

14. The light duty oil burner as defined in claim 13, wherein said sliding tube is in thermal contact with said heating means and sealed thereagainst.

15. The light duty oil burner as defined in claim 13, wherein said sliding tube is disposed on said heating means with radial play and sealed against said nozzle holder, the sealing face of said choke on said sliding tube mates with a sealing face around said heating means, said sliding tube being adapted to fit around said servo member and to be moved in relation to said nozzle holder, and spring closing means for maintaining said sliding tube in contact with said nozzle holder.

16. The light duty oil burner as defined in claim 15, wherein the force exerted by the steady state pressure of said pressure chamber is greater than the force of said closing spring.

17. The light duty oil burner as defined in claim 14, wherein a simple bellows is disposed around said closing spring so that said servo member is joined to a stationary part of said nozzle head positioned opposite said double bellows.

18. The light duty oil burner as defined in claim 15, wherein said sliding tube is provided with an extension adjoining its sealing face and disposed around a filter, said extension defining a ring-like gap adjoining said choke in the oil flow path upstream from the injection nozzle.

19. The light duty oil burner as defined in claim 1, wherein said pressure chamber is provided with an outlet gap having a constant cross section and oil is supplied thereto, the pressure of said oil being adjusted in response to the energy requirements of the heat exchanger.

20. The light duty oil burner as defined in claim 19, wherein the oil supplied to said bellows flows through said bellows.

21. The light duty oil burner as defined in claim 20, which further comprises valve means for controlling the oil supply to the light duty oil burner, and means for controlling said valve means in response to the energy requirements of the heat exchanger.

22. The light duty oil burner as defined in claim 21, wherein said means for controlling said valve means includes a servo motor operated in response to the energy requirements of the heat exchanger.

23. The light duty oil burner as defined in claim 21, wherein said pump is a multi-stage pump controlled in response to the energy requirements of the heat exchanger.

24. The light duty oil burner as defined in claim 1, wherein means are provided for determining the energy requirements of the heat exchanger as a function of the temperature rise rate in the heat exchanger.

25. The light duty oil burner as defined in claim 1, which further includes means for considering the ambient temperature outside the heat exchanger on the means for adjusting the oil pressure in the oil flow path to the injection nozzle responsive to the energy requirements of the heat exchanger as a level setting in the form of a cascade value.

26. The light duty oil burner as defined in claim 1, wherein the pressure chamber formed by said double bellows is disposed between said servo member and said nozzle mount.

27. The light duty oil burner as defined in claim 11, wherein the means for adjusting the oil pressure in the oil flow path to the injection nozzle comprises an axially moveable heating rod having radial play, said rod being energized in response to the energy requirements of the heat exchanger and said choke means in the oil flow path comprises a stationary sealing face in the vicinity of said injection nozzle and a ball on the corresponding end of said heating rod which together form a ball valve.

* * * * *